United States Patent [19]

Barnes

[11] Patent Number: 4,645,016

[45] Date of Patent: Feb. 24, 1987

[54] RESONANT PILE DRIVING SYSTEM

[75] Inventor: Frank S. Barnes, Boulder, Colo.

[73] Assignee: University Patents, Inc., Westport, Conn.

[21] Appl. No.: 730,420

[22] Filed: May 6, 1985

Related U.S. Application Data

[63] Continuation of Ser. No. 509,084, Jun. 29, 1983, abandoned.

[51] Int. Cl.[4] ..... B23B 45/16

[52] U.S. Cl. ..... 173/134; 173/32; 173/132; 173/125; 405/232

[58] Field of Search ..... 173/20, 32, 125, 132, 173/133, 134, 139, 49; 175/56; 405/232; 299/14

[56] References Cited

U.S. PATENT DOCUMENTS 2,948,122 8/1960 Smith ..... 405/232 X 3,200,893 8/1965 Leavell ..... 173/139 X 3,650,335 3/1972 Lee et al. ..... 173/125

FOREIGN PATENT DOCUMENTS 2385495 1/1978 France ..... 173/139

56-25517 11/1981 Japan ..... 173/20

*Primary Examiner*—E. R. Kazenske

*Assistant Examiner*—Willmon Fridiel

*Attorney, Agent, or Firm*—David N. Koffsky; George M. Yahwak

[57] ABSTRACT

A pile driver is described wherein a piston within an internal combustion engine is rigidly coupled to the pile to be driven. The engine is resiliently coupled to the pile so as to move with the pile. Control circuitry modifies the frequency of operation of the piston so as to make the impulses created thereby synchronous with reflected impulses within the pile.

5 Claims, 3 Drawing Figures

RESONANT PILE DRIVING SYSTEM

This is a continuation of application Ser. No. 509,084 filed June 29, 1983, now abandoned.

This invention relates generally to means for driving piles, pipes, posts, etc., and, more particularly to means for driving such in a resonant mode.

PRIOR ART

The concept of resonant pile driving is well known and one of its prime proponents has been A.G. Bodine, Jr. See his U.S. Pats. Nos. 2,975,846, 3,283,838, and 3,808,820 as well as many others. As discussed in the aforementioned patents, resonant pile driving is relatively simple in its conception. The desired result in resonant pile driving is to achieve a hammer impact frequency which is coincident with the resonant frequency of the pile being driven. That resonant frequency is defined as the time elapsed between the application of an impulse to one end of the pile and the time it takes that impulse to travel down the length of the pile, be reflected and returned to a point where the impulse of energy was initially applied.

The resonant method of pile driving may be likened to pushing a child on a swing in a synchronous manner whereby each push adds to and reinforces the energy contained within the swing itself. In a like manner, when a pile is impacted at the time the impulse of the previous impact is just departing (after reflection), the two energy impulses add and reinforce one another and enable much better pile penetration into the soil. In the well-known hammer-type pile drivers, very substantial losses of energy, in the form of pile heating, occur as a result of the asynchronous operation of the driving hammers.

The resonant pile-driving mechanism described in the aforementioned Bodine, Jr. patents involves a hammer mechanism which is driven by a large set of eccentric cams. The problem with such mechanisms is fundamental i.e., having to spin unbalanced large weights. Those weights, when spun properly, achieve a resonant impulse mechanism capable of performing the pile-driving function. The problem is that when such weights are spun, it is extraordinarily difficult to keep the pile-driving mechanism in its proper position and to prevent it from shaking itself to pieces. In order to render the mechanism operable—at least for a short period of time—it must be constructed on a massive scale and as such becomes unwieldy to operate in a field environment.

It is therefore an object of this invention to provide a pile-driving mechanism which avoids the generation of forces not directly co-linear with the axis of the pile.

It is another object of this invention to provide an improved pile-driving mechanism wherein all forces exerted upon the pile are co-linear with the pile's axis.

It is a further object of this invention to provide a resonant pile-driving mechanism wherein the speed of operation of the pile-driving mechanism can be altered so as to match the resonant frequency of the pile.

SUMMARY OF THE INVENTION

In accordance with the above objects, an internal combustion engine is provided, wherein piston means are operated by the engine and are rigidly coupled to the pile or other member to be driven. The engine, including the cylinder head, etc. is resiliently coupled to the pile so that it moves with the pile as the pile moves into the soil. The piston means is operated in the conventional manner such that each time combustion occurs in the cylinder head, the piston reacts downwardly thereby causing the pile to also be impulsed. Means are provided to alter the speed of operation of the engine in accordance with the resonant frequency of the pile being driven. All forces exerted by this structure on the pile are directly co-linear with the axis of the pile.

DETAILED DESCRIPTION

Figure 1:
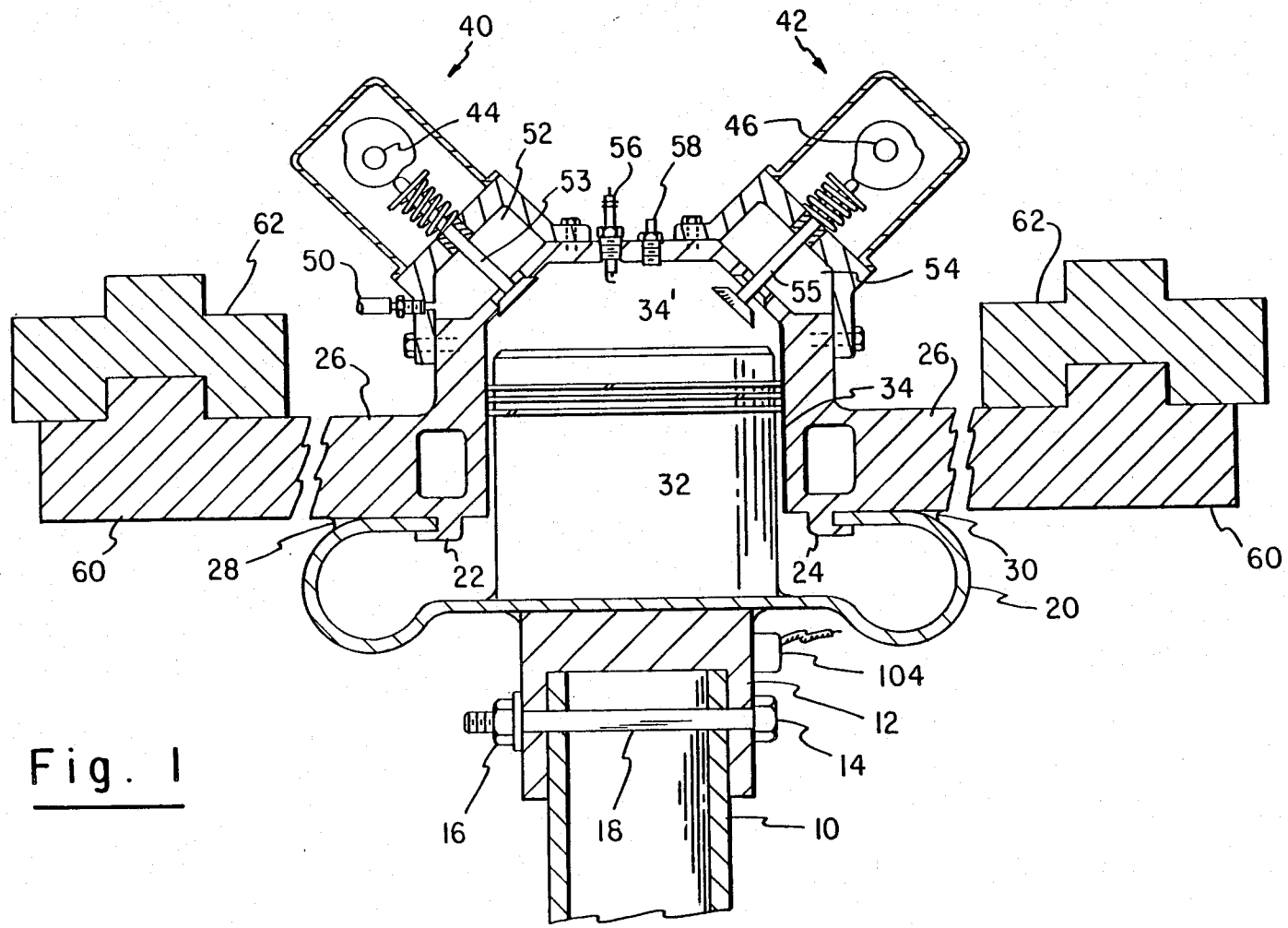
FIG. 1 is a sectional view of the invention.

Referring now to FIG. 1, the uppermost portion of pile 10 is firmly held in the jaws of chuck 12 by bolts 14 and 16 and shaft 18. Chuck 12 is welded to a donut-shaped resilient metal spring 20, which is in turn held in place by protrusions 22 and 24 from engine block 26. Spring 20 may also be welded around its periphery to engine block 26 such as shown at 28 and 30.

A piston 32 is slidably mounted within cylinder 34 of engine block 26. Cylinder 32 is welded or otherwise rigidly attached to spring 20. Spark plug 56 and fuel injection inlet 58 communicate with chamber portion 34' of cylinder 34. The movement of piston 32 is linear within cylinder 34 and is aligned with the center line of chuck 12 and pile 10. The movement of piston 32 is further constrained by the action of spring 20 as will be hereinafter described.

Figure 3:
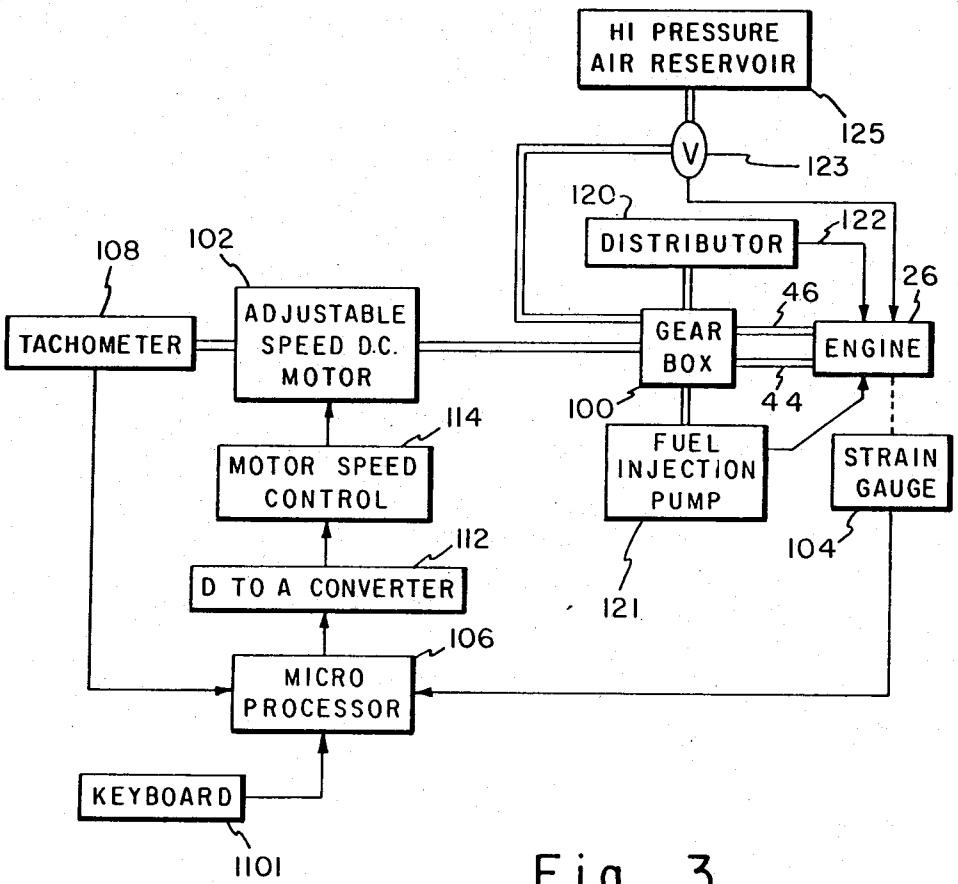
FIG. 3 is a block diagram which illustrates the controls for the invention.

Intake and exhaust assemblies 40 and 42 are similar to those found in normal internal combustion engines. Each contains a cam mounted on a rotatable shaft, 44, 46 which cam bears upon the upper portion of a spring-biased valve, e.g., inlet valve 53 and exhaust valve 55. The valves are opened and closed by the rotation of the cams about their respective shafts. As is shown in FIG. 3, shafts 44 and 46 are coupled to a gear box 100, which in turn is coupled to an adjustable speed DC motor 102. Motor 102 controls through gear box 100, the speed of rotation of shafts 44 and 46.

Gear box 100 also controls and times, the operation of valve 123 which in turn connects a reservoir 125 of high-pressure air via hose 50 (FIG. 1) to inlet chamber 52.

Exhaust chamber 54 is connected to an appropriate exhaust muffling system (not shown).

Engine block 26 is constructed so as to have extended portions 60 on which weights 62 may be emplaced. Weights 62 both bias engine block 26 against spring 20 and pile 10 and limit the upward travel of engine block 26 when the fuel in cylinder 34 is ignited.

Referring now to FIG. 3, the control system will be briefly described. As aforementioned, adjustable speed DC motor 102 is coupled through gear box 100 to shafts 44 and 46 which, in turn, control the opening and closing of the inlet and outlet valves 53 and 55 respectively. A strain gauge 104 is attached to chuck 12 (FIG. 1) and has its output fed to microprocessor 106. The output from tachometer 108 is also fed to microprocessor 106 and indicates the speed of rotation of motor 102. Keyboard 110 is employed to provide manual inputs to microprocessor 106. The digital output from microprocessor 106 is converted to an analog signal via digital to analog converter 112; which analog output is then applied to motor speed control 114; which in turn controls the speed of motor 102.

Motor speed control unit 114 and motor 102 are well known in the art and are available from a number of commercial source. One appropriate motor speed control is marketed by the General Electric Company under the trade name Statotrol II Adjustable Speed Drive.

Gear box 100 is further coupled to distributor 120 which is connected via conductor 122 to spark plug 56. An output from gear box 100 also controls the operation of fuel injection pump 121 such that fuel is injected into cylinder 34 via port 58 at the proper time in the engine's cycle. Thus the speed of engine 26 is directly controllable in the conventional manner by the speed of motor 102 as it is fed into and through gear box 100 to control shafts 44 and 46, distributor 120, and fuel injection pump 121.

The object of this system is to operate piston 32 at the resonant frequency of pile 10. Thus, piston 32 is to be caused to travel in a downward direction and provide a pulse of energy into pile 10 in a manner timed to the arrival and departure of reflected energy impulses at strain gauge 104. The speed of an energy impulse within pile 10 is approximately the velocity of sound in the pile (5960 meters per second). Thus the time for an energy impulse to travel down the length of a pile and back again may be easily calculated. For instance, the transit time of an energy pulse in a 40 foot long pile is 2 milliseconds. Thus, if energy is to be imparted to such a pile in synchronism with the reflected energy impulse, piston 32 must be actuated at a rate of 244 cycles per second to drive the pile in its fundamental mode. (It is also possible to drive the pile at a harmonic or subharmonic with somewhat reduced efficiency)

It can be shown that for a wide variety of piles, pipes, etc., the speed of operation of piston 32 should be variable between approximately 15 cycles per second—for very long and thick piles—to approximately 300 cycles per second for short, thin pipes. For some small pipes, the speed may need to approach 500 cycles per second. At such rates of operation, the piston stroke must, of necessity, be very short i.e. on the order of a few millimeters to at most, an inch or two. Nevertheless, because of the high repetition rate of the piston, substantial penetrations of a pile into the soil can be achieved. For example, at a rate of 50 pulses per second and a movement of the piston of one (1) millimeter per pulse, it will take approximately one (1) minute for a pile to proceed 10 feet into the earth. Thus a 40 foot pile could be put into place in less than 5 minutes.

Because of the short stroke of piston 32, its upward travel cannot be used to exhaust the gas in the cylinder. Thus source of pressurized air 125 must be employed to provide this capability.

Figure 2:
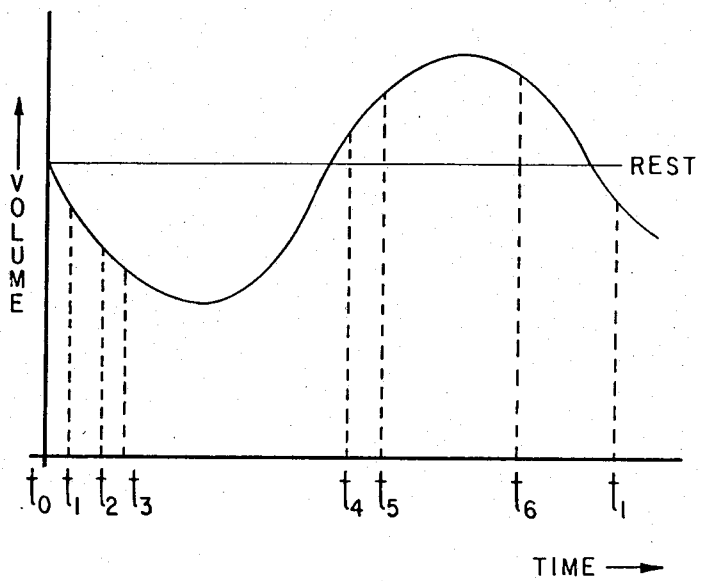
FIG. 2 is a plot of cylinder volume versus time and is useful in understanding the operation of the invention.

With reference now to FIG. 2 in combination with FIGS. 1 and 3, the detailed operation of the invention will now be described. Assume at time $t_0$ that piston 32 is traveling in an upward direction; that exhaust valve 55 is closed, intake valve 53 open and that valve 123 is open thereby allowing pressurized air from inlet 50 to fill chamber 34' of cylinder 34. At time $t_1$, inlet valve 53 is closed as is air inlet valve 123. Shortly thereafter, at time $t_2$, fuel injection pump 121 injects fuel into chamber 34' through inlet 58. At time $t_3$, distributor 122 provides an impulse to spark plug 56 which causes combustion of the fuel-air mixture in chamber 34' and piston 32 begins to move downwardly. Engine block 26 reacts to the combustion in chamber 34' by moving upwardly but is constrained from substantial movement by outboard weights 62 and spring 20.

The downward movement of piston 32 imparts an impulse of force to pile 10 through chuck 12. That impulse is also sensed by strain gauge 104 and fed to microprocessor 106. Microprocessor 106 digitizes the electrical signal and compares it to a stored preset level. If the level of the signal from strain gauge 104 exceeds a preset level, microprocessor ignores the input. (It is only interested in the reflected impulses which are sensed by strain gauge 104—which are of lower amplitude than the impulse caused by the primary force impulse from piston 32.)

At time $t_4$, exhaust valve 55 is opened, thereby enabling excess pressure to be removed from chamber 34' through exhaust manifold 54. At time $t_5$, inlet valve 53 is opened as is air inlet valve 123, allowing pressurized air to scavenge the combustion products from chamber 34' and propel them into exhaust manifold 54. Both valves 53 and 55 remain open until time $t_6$ when exhaust valve 55 is closed and chamber 34' begins to be pressurized by the high-pressure air flowing in through valve 53. The cycle then repeats itself.

As should now be realized, the timing of the system of FIG. 1 is directly dependent upon the output speed of DC motor 102. That output speed is controlled by the output from strain gauge 104 into microprocessor 106. Microprocessor 106 is programmed to sense the arrival of the reflected impulse at strain gauge 104 and to provide an error voltage to motor speed control unit 114. The error voltage is created by microprocessor 106 first sensing that the input from strain gauge 104 is a proper "reflected" impulse (as aforedescribed) and then digitizing the impulse wave shape. Microprocessor 106 then examines the digitized wave shape to determine the time of occurrence of its maxima, which maxima value is subsequently stored. In response to that stored signal, microprocessor 106 provides an output which causes motor speed control 114 to slightly increase the speed of DC motor 102 so that the rate of operation of piston 32 is also increased. Upon sensing the next reflected impulse, if the maxima level thereof is higher than the previously stored level, it repeats the process. If the signal decreases, indicating that the maxima has passed and is beginning its next excursion down pile 10, microprocessor 106 slows down the speed of motor 102. This process thereby ends up oscillating by one step back and forth around the maxima of the reflected impulse, thereby achieving rather precise speed control of piston 32 so that its primary impulses on pile 10 act to reinforce the received impulses in a synchronous and resonant fashion.

Tachometer 108 is used mainly in a second mode of operation where the operator, via keyboard 110, provides an input command to microprocessor 106 to set the DC motor at preset speed. The input from tachometer 108 is used to provide a comparison so that microprocessor has positive control of the speed of the motor.

It will be understood that the drawings and description are merely illustrative and not restrictive of the nature and scope of the invention and show illustrative embodiments thereof. Modifications of the invention may be contemplated by those skilled in the art and are intended to fall within the scope hereof. For instance, while a single piston is shown, multiple pistons could also be employed as could multiple input/output valving schemes so as to enable more rapid inlet and out take of gases. With n multiple pistons, each piston could operate at a rate of $n^{-1}$ thereby achieving an effectively lower frequency of operation. Furthermore, the method shown for securing the pile 10 to chuck 12 is merely illustrative and there are many alternative means of rigidly securing such said members, one to the other. In addition, while a water jacket is shown about piston 32, it is possible to air cool the engine provided sufficient radiating surfaces are available and the speed of operation thereof is not excessive. Finally, the method of lubricating piston 32 has been omitted from the drawings to avoid overcomplication thereof. Several methods of lubrication are available. It the engine is run as a two-cycle machine, the lubricating oil can be added directly to the fuel and lubrication provided thereby. More preferably, Lubricating orifices in the side walls of cylinder 34 may be provided which would enable pressurized oil to bathe the piston rings and wall surfaces.

I claim:

1. In an internal combustion system for driving an elongated member into a resistive medium, the combination comprising:

piston means;

coupling means for detachably coupling said piston means to said elongated member so as to prevent independent movement therebetween;

an internal combustion engine provided with cylinder means which houses said piston means, an explosive force within said cylinder means being transferred via said piston means through said coupling means to said elongated member;

resilient coupling means located between said engine and said elongated member and connecting each to the other, said resilient coupling means allowing independent movement between said cylinder means and said elongated member while providing a predetermined positional relationship between said cylinder means and elongated member when at rest; and means for operating said engine to impart successive force impulses to said piston means and its connected elongated member, such action, in combination with said resilient coupling means causing said cylinder means and piston means to exhibit a relative linear reciprocating motion with respect to each other.

2. The invention of claim 1 further including: control means coupled to said engine means for causing said engine means to operate said piston at the approximate resonant frequency of said elongated member.

3. The invention of claim 2, wherein the axis of said cylinder means is co-linear with said elongated member.

4. The invention of claim 3 further including weight means for biasing said engine through said resilient coupling means against said elongated member.

5. The invention of claim 4, wherein said operating means includes sensor means coupled to said elongated member, said sensor means adapted to detect the presence of an energy impulse and to provide a signal indicative thereof; and ignition and valve means responsive to said signal to cause a detonation of fuel in said cylinder means such that said piston means is moved against said elongated means to reinforce said energy impulse in synchronism with its presence at said sensor means.

* * * * *